US006336650B1

(12) United States Patent
Alspaugh

(10) Patent No.: US 6,336,650 B1
(45) Date of Patent: Jan. 8, 2002

(54) STANCE VARIABLE ONE MOTION STEP-IN SNOWBOARD BINDING

(76) Inventor: Clayton Neil Alspaugh, 211 Aspen Dr., Lyons, CO (US) 80540

( * ) Notice: Subject to any disclaimer, the term of this patent is extended or adjusted under 35 U.S.C. 154(b) by 0 days.

(21) Appl. No.: 09/378,052

(22) Filed: Aug. 20, 1999

Related U.S. Application Data

(60) Provisional application No. 60/097,522, filed on Aug. 21, 1998.

(51) Int. Cl.[7] ..... A63C 9/00

(52) U.S. Cl. ..... 280/613

(58) Field of Search ..... 280/607, 611, 280/613, 617, 618, 619, 623, 626, 629, 632, 633, 634, 636, 14.21, 14.22, 14.24, 87.041, 87.042; 36/117.1, 117.2, 117.3, 117.4, 117.6, 117.7, 118.1, 118.2, 118.3, 118.7, 118.8; 441/65, 68, 70, 74, 75; 403/83, 84, 88, 89

(56) References Cited

U.S. PATENT DOCUMENTS

| | | | | | |
|---|---|---|---|---|---|
| 3,771,811 | A | * | 11/1973 | Bueno | 280/87.041 |
| 3,899,190 | A | * | 8/1975 | Schweizer et al. | 280/11.35 |
| 3,950,000 | A | * | 4/1976 | Sittmann | 280/11.35 |
| 4,191,395 | A | | 3/1980 | Salomon | |
| 4,652,007 | A | | 3/1987 | Dennis | |
| 4,653,203 | A | * | 3/1987 | De Mattheis | 36/117 |
| 4,871,337 | A | | 10/1989 | Harris | |
| 4,964,649 | A | | 10/1990 | Chamberlin | |
| 5,021,017 | A | | 6/1991 | Ott | |
| 5,044,654 | A | | 9/1991 | Meyer | |
| 5,054,807 | A | | 10/1991 | Fauvet | |
| 5,085,455 | A | | 2/1992 | Bogner et al. | |
| 5,125,680 | A | | 6/1992 | Bejean et al. | |
| 5,156,644 | A | | 10/1992 | Koehler et al. | |
| 5,188,386 | A | | 2/1993 | Schweizer | |
| 5,277,635 | A | * | 1/1994 | Gillis | 441/74 |
| 5,354,088 | A | | 10/1994 | Vetter et al. | |
| 5,474,322 | A | | 12/1995 | Perkins et al. | 280/613 |
| 5,553,883 | A | | 9/1996 | Erb | |
| 5,669,630 | A | | 9/1997 | Perkins et al. | |
| 5,697,631 | A | | 12/1997 | Ratzek et al. | |
| 5,704,139 | A | * | 1/1998 | Okajima | 36/115 |
| 5,819,440 | A | * | 10/1998 | Okajima | 36/117.1 |
| 5,820,155 | A | * | 10/1998 | Brisco | 280/607 |
| 5,913,530 | A | | 6/1999 | Berger et al. | |

FOREIGN PATENT DOCUMENTS

| | | | | |
|---|---|---|---|---|
| EP | 0408824 A2 | * | 1/1991 | 280/613 |
| FR | 2604913 | * | 4/1988 | 36/117.3 |

OTHER PUBLICATIONS

Winter '97–'98 Ski & Snowboard Times, vol. VI, No. II.
1997 Berger Produts/The 360 Step On Binding, pp. 1 & 2.

* cited by examiner

*Primary Examiner*—Brian L. Johnson
*Assistant Examiner*—G B Klebe
(74) *Attorney, Agent, or Firm*—Chrisman, Bynum & Johnson, P.C.

(57) ABSTRACT

An on-the-hill 360° adjustable attack angle boot and binding system has a central mounting post fixed to a board. Surrounding the post is a friction pad to grip the boot sole. The boot sole has a convex spring reaching from heel to toe to transfer the boarder's weight from heel to toe, thereby forcibly engaging the friction pad.

22 Claims, 12 Drawing Sheets

STANCE VARIABLE ONE MOTION STEP-IN SNOWBOARD BINDING

CROSS REFERENCED PATENTS

This application claims priority from Applicant's provisional application No. 60/097,522, filed Aug. 21, 1998, which is incorporated herein by reference.

FIELD OF INVENTION

The present invention relates to snowboard bindings especially those designed to offer on the hill attack angle rotational adjustment and/or a stance width adjustment.

BACKGROUND OF THE INVENTION

The sport of snowboarding is growing rapidly. Every day new skiers/snowboarders enter a rental ski shop and take their first ride. Unfortunately, most new boarders do not know their left foot from their right. This means the novice rider does not know which is his favored lead foot until he is on top of a mountain. If the ski shop guessed wrong, then the boarder cannot alter his stance until he returns to the ski shop. Most bindings are pre-set as to which is the lead foot as well as the relative angles of each binding to the longitudinal axis of the board. Fine tuning generally necessitates ski-shop adjustments. Generally, the forward foot is placed at an angle with respect to the longitudinal centerline of the snowboard during the snowboarding. Still further, most snowboarders like to have their feet as close to the snow as possible for reasons of control, comfort, and the like. Still further, some snowboarders like to have their foot at one angle while others like to have their foot at another angle, and some snowboarders actually like to change the angle depending on conditions associated with the activity. Also, a boarder may wish to have his feet at two different angles. Still further, some snowboarders like to have different stance widths (distance between feet and relative to board center either offset forward or back).

As noted above, most snowboarding is carried out with one foot, preferably the lead foot, oriented at an extreme angle with respect to the longitudinal centerline of the snowboard. While this is effective and efficient for snowboarding, it is not desirable under all circumstances. Specifically, it is not desirable when skating or when riding a ski lift. Skating is effected by removing one foot, such as the rear foot, from the snowboard and using that removed foot to contact the snow and propel the snowboarder forward in a skating movement. As can be understood, if the foot remaining attached to the snowboard is at an extreme angle with respect to the longitudinal centerline, skating will be uncomfortable and awkward and may even place undue stress on the snowboarder's body.

Another problem with the angled orientation of the snowboarder's foot on the snowboard occurs when the snowboarder is riding a ski lift. The angled orientation of the board with respect to the wearer may cause the board to be at an angle with respect to the wearer when that wearer is riding the ski lift. This may cause the board to contact other equipment or to contact other skier's equipment, or to be located in an undesired position. This, in turn, may require the wearer to twist his or her foot into an uncomfortable position while on the lift to hold the snowboard straight. Given the weight and length of the snowboard, holding the snowboard straight via twisting the foot or leg is very stressful to the body.

Some snowboarders actually remove their snowboards when moving across level ground or when riding a ski lift.

This is cumbersome. It is also undesirable when the snowboarder demounts the ski lift as he or she must move out of line to replace the snowboard. Holding the snowboard while riding the lift is a potential hazard for skier's below the lift path.

Still further, requiring the snowboarder to maintain his or her foot attached to a snowboard at an angle may be undesirable if the snowboarder wishes to alter his or her snowboarding style or technique during a snowboarding activity. Such altered style or technique may be required or desired due to changed snow conditions, changed slope conditions or type of riding (i.e. half-pipe, racing, freeriding etc.). The snowboarder may wish to change his or her speed of snowboarding, or even to change his or her style altogether, or to change the amount of control exerted over the activity.

In some conditions, the snowboarder may want to alter the angular orientation of his or her lead foot. He or she may even want to switch his or her lead foot. He or she may even want both feet to be at an adjusted angle with respect to the snowboard longitudinal centerline.

The difference in styles and desires of snowboarders is most evident in the rental market. One snowboarder may have a preferred position and orientation with respect to the snowboard for a given condition and skill level, while another snowboarder may have an entirely different position and orientation for the same condition. Therefore, rental snowboards must be changed to suit the renter.

In the past, snowboards have required that the snowboarder's foot be completely separated from the snowboard to effect any significant change in angular orientation of the foot with respect to the longitudinal centerline of the snowboard. The change is effected by removing the snowboarder's foot, loosening fasteners and removing anchoring means which attaches bindings to the snowboard, re-orienting the anchoring means, and re-attaching the fasteners to the binding and snowboard, then re-attaching the snowboarder's foot to the binding.

A summary of the prior art is noted below. There are two basic types of snowboard bindings, namely, strap or step-in. From the summary below, only Erb and Berger™ offer an adjustable 360° stance angle on the hill. Erb is a strap system. Strap systems waste time on the hill and necessitate sitting down to secure the boot to the binding. Step-in systems allow the boarder to enter and dismount while standing. This is a convenience. Berger™ is the only step-in 360° adjustable stance angle system known. The present invention provides a firmer grip of the boot to the snowboard as well as providing a spring torsion ride, improvements to the Berger™ system. Also offered is an optional stance width adjustment and a one-motion step-in.

Below follows a brief description of the prior art.

U.S. Pat. No. 5,697,631 (1997) to Ratzek et al. discloses retractable pins in a boot heel which engage a binding element on the snowboard.

U.S. Pat. No. 5,669,630 to Perkins et al. discloses a snowboard binding. FIG. 1 of Perkins shows a snowboard 14, a boot 16 which is releasably attached to the snowboard 14 by binding 12. Each boot 16 has a pair of locating pins 18 that extend from a bottom surface 20 of the boot 16 (best shown in FIG. 2). The insert plate 30 of the bindings has a pair of protrusions 34 that extend into the pin apertures 26. A locking arm secures the pins to the snowboard baseplate. No 360° adjustment exists.

U.S. Pat. No. 5,474,322 to Perkins et al. discloses a snowboard binding. According to Perkins, the snowboard binding can readily attach and release a boot from a snowboard. FIG. 1 of Perkins shows a snowboard 14, a boot 16 which is releasably attached to the snowboard 14 by binding 12. Each boot 16 has a pair of locating pins 18 that extend from a bottom surface 20 of the boot 16 (best shown in FIG. 2). The insert plate 30 of the bindings has a pair of protrusions 34 that extend into the pin apertures 26. No 360° adjustment is provided.

U.S. Pat. No. 5,354,088 to Vetter et al. discloses a coupling for releasably mounting a boot with boot binding to a turnable 30 which is adjustably secured 360° to a snowboard 100. The boot binding includes a plurality of extending lock pins each with a shoe releasably locking into arcuate slot in the turntable. This is either a step in or a strap system.

U.S. Pat. No. 5,188,386 to Schweizer discloses a binding mounting apparatus 20 having a baseplate 25 which is mounted to a board surface 21 of a snowboard. A pivot stem 30 with an enlarged head portion 31 is secured to the baseplate 25. A boot mounting plate has a least one mounting through hole and a stem through hole. The pivot stem is positioned within the stem through hole. Such stem through hole is sized large enough for the pivot stem to fit within the stem through hole and small enough for the enlarged head to prevent the mounting plate from moving beyond or traveling over the enlarged head portion when the apparatus is tightened. A riser rim allows a tilt on the boot.

U.S. Pat. No. 5,156,644 to Koehler et al. discloses a safety release binding 12 for attachment of a foot of a user to a riding device having a first attachment unit 13 formed to be secured to the foot of the user. The first attachment 13 comprises interlocking elements 19 for engaging interlocking elements 22 mounted on rotatable lever 44 (FIGS. 1,5).

U.S. Pat. No. 5,125,680 to Bejean et al. discloses a device for binding a shoe or boot to a cross-country Ski. The system includes an upper support plate which is movably mounted along a direction having a component which is substantially perpendicular to the ski. The system further includes an elastic means for elastically biasing the movable support plate in a direction separating it from the ski.

U.S. Pat. No. 5,085,455 to Bogner et al. discloses a sporting board with two boot bindings (11, 11'), arranged at a considerable angle to the longitudinal direction of the board. The release mechanism of the two plate bindings (11,11') are coupled together in such a way that during release of the one plate binding (11) the release force for the other respective plate binding (11') is at least substantially reduced.

U.S. Pat No. 5,054,807 to Fauvet discloses a binding arrangement for use with a gliding board such as a snowboard. FIG. 1 shows an assembly of releasable bindings 1*a*, 1*b* mounted on a snowboard 10. The assembly includes a first releaseable binding 1*a* which is rigidly affixed a second boot 2*b* to snowboard 10.

U.S. Pat No. 5,044,654 to Meyer discloses a plate release binding for winter sports devices comprising a mobile binding plate 1 of oblong basis outline with a widened mid-section and a vertical central bore 28.

U.S. Pat. No. 5,021,017 to Ott discloses a water sports board 1 having a base 11 formed with rows of detent teeth 16 for locking engagement with the peripheral teeth 26 of binder plates 22 so that the binder plate may be angularly or longitudinally adjusted relative to the base.

U.S. Pat. No. 4,964,649 to Chamberlin discloses a snowboard boot binder attachment mechanism 10 and 10*a*. The boot binder mechanism 10 is secured to a snow board 12 with each mechanism 10 having connected thereto bootbinders 14, 14*a* disposed at the desired angular relationship relative to snowboard 12 for attachment to boot 13. See FIGS. 6,7 and col. 3, lines 50–55 for linear and angular adjustment of the binder. Rotational torque action is provided.

U.S. Pat. No. 4,871,337 to Harris discloses a binding with longitudinal and angular adjustment. FIGS. 1–2 of Harris discloses a riding board 10 having binding 58 which functions to attach at least one of a rider's limbs to a first riding plate 48. The riding plate is positioned above the channel section formed within a rider support surface of the riding apparatus. Fasteners supported by each riding plate are releasably engagable with retaining elements installed within the channel section. After loosening the fasteners from the retaining elements, each riding plate may be repositioned angularly or longitudinally with respect to its channel section. Thereby permitting the apparatus to be used with a variety of stances and leg spacings.

U.S. Pat. No. 4,652,007 to Dennis discloses a releasable binding system for snowboarding. The binding release includes at least a forward toe piece binding clip assembly 15 which is mounted on the board and a heel engaging safety release clip assembly 16.

U.S. Pat. No. 4,191,395 to Salomon discloses a ski-boot element which is connected to a boot and comprises a depression in which is located a pivot running towards the lower surface of the element. The depression receives a block integral with the ski, while locking means assure that the boot is held to the ski. Also the depression may be in a plate attached at least temporarily under the sole of the boot.

U.S. Pat. No. 5,553,883 to Erb discloses a binding footplate 10 for attaching a snowboarder's foot to a snowboard 12. The binding 10 includes a footplate 30 which is fixed to the user's foot via the boot. Straps S and rear foot supports R are used to secure the snowboarder's foot/boot to footplate 30. Locking pins allow a 360° on the hill adjustment of the footplate. This is a strap system.

The Berger 360™ by Berger Snowboard Products, www.berger.360.com, offers the only known 360° on the hill adjustable system which is a step-in type. A board-mounted base is circular having a central mounting post. The boot has a central receiving hole to accept the central mounting post, wherein the post rotates inside the hole. A cable release on the boot releases the central mounting post for dismounting. A lever and pin assembly locks the boot at a desired angle by securing the pin in a peripheral notch in the circular base. The system offers a direct boot-to-board contact with a soft boot.

The present invention is a central mounting post-type system which provides a spring-steel insert in the boot sole which transmits the border's force all along the sole from heel to toe. Quick-release straps secure the foot in the soft upper boot to the rigid sole. Friction compression pads on the board prevent lateral rotation of the boot and movement between the boot and the board. Other features include an in-boot plastic lower leg and ankle support, a central post runner track for stance width adjustment, and lever-action angulation for greater control. This is a one motion step-in system.

SUMMARY OF THE INVENTION

The main aspect of the present invention is to provide a central mounting post binding system having an arch spring to spread the levered force from heel to toe.

Another aspect of the present invention is to provide a single-action step-in binding system.

Another aspect of the present invention is to provide a friction pad between the boot and the board to create a lateral-hold ridge when the foam pad under the rider's foot is compressed and to increase grip.

Another aspect of the present invention is to provide an in-boot lower-leg and ankle stablizer to increase control.

Another aspect of the present invention is to provide a multi-tier torsion ride with layers of springs and cushioning to absorb shocks and accentuate weighting/ unweighting.

Another aspect of the present invention is to provide for play (that continually transfers force) between the boot and board and not between the foot and boot.

Another aspect of the present invention is to provide a binding for a snowboard which permits quick and reliable reorientation of the snowboarder's foot with respect to the longitudinal centerline of the snowboard on the hill.

Another aspect of the present invention is to provide a binding for a snowboard that permits a snowboarder to significantly alter the angular orientation of one or both of his or her feet with respect to the snowboard without releasing his or her feet or foot from the snowboard while also positioning the snowboarder's foot as close to the plane of the snow as needed so efficient control of the snowboard can be effected by the snowboarder.

Another aspect of the present invention is to provide a binding for a snowboard that permits a snowboarder to alter the angular orientation of one or both of his or her feet with respect to the longitudinal centerline of the snowboard on the hill so the foot can be moved from toes facing left of the longitudinal centerline to the toes facing right of that longitudinal centerline and also allow the snowboarder to face either to the relative front of the snowboard or to the rear of the snowboard.

Another aspect of the present invention is to provide a binding for a snowboard that permits a snowboarder to alter the angular orientation of one or both of his or her feet with respect to the longitudinal centerline of the snowboard by as much as 360° without significantly releasing or removing the foot from the snowboard.

Another aspect of the present invention is to provide a binding for a snowboard that permits a snowboarder to keep his feet in the most comfortable position relative to the snow.

Another aspect of the present invention is to provide a binding for a snowboard that permits a snowboarder to keep his feet in the most comfortable position for the particular activity and conditions occurring at any given time or terrain.

Another aspect of the present invention is to provide a binding for a snowboard that is suitable for a rental market.

Another aspect of the present invention is to offer an adjustable-width binding which is also 360° adjustable as noted above.

Another aspect of the present invention is to provide a snowboard boot/binding system that is compatible with other snow sport instruments (i.e. snowshoes, crampons, telemark skis, etc.).

Another aspect of the present invention is to provide a binding system that can be used in others sports (ie. Mountain Biking, Road Cycling, etc.) A cycler's boot could snap onto a mounting post on the pedal.

Other aspects of this invention will appear from the following description and appended claims, reference being made to the accompanying drawings forming a part of this specification wherein like reference characters designate corresponding parts in the several views.

A customized soft snowboard boot has a spring from heel to toe which rises at the arch. Thus, the boarder's weight and/or control force is transmitted from heel to toe. A central mounting post(s) is mounted on the board. The boot sole and spring assembly has a receiving hole for the central mounting post. The central mounting post has a receiving groove that enables a locking fork to engage. A circular friction pad encircles the central mounting post to grip the boarder's boot sole offering good control and disallowing a lateral rotation. To adjust the attack angle of the boot, the boarder merely pulls a release cable and rotates the boot then re-weights on that foot. Further boot to board control is accomplished with a pair of quick release straps. Additional control is gained with an inner boot plastic stiffener. A torsion ride is accomplished with several layers of cushioning and springs. Conventional boots can be retrofit into the custom boot needed for this system.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DESCRIPTION OF THE PREFERRED EMBODIMENT

Figure 1:
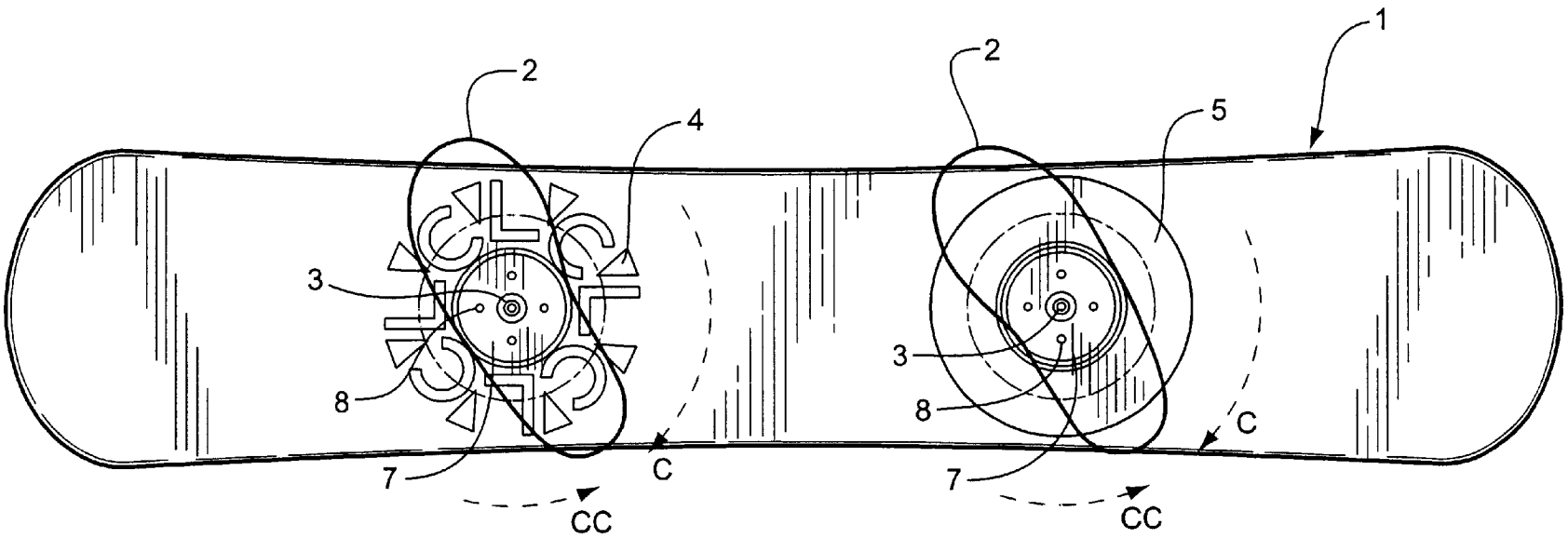
FIG. 1 is a top plan view of a snowboard having a pair of binding bases affixed thereto and showing boot sole profiles.

Referring first to FIG. 1 a snowboard 1 has boots 2 attached to central mounting posts 3 to provide on-the-hill 360° attack angle selection shown by clockwise and counterclockwise arrows C, CC. Two styles of board-mounted friction pads are shown. Pad 4 had the boarder's initials shown (LC) for security reasons. Pad 5 is a simple washer-style design. Both pads 4, 5 must provide a bootpad interface at the middle of the bootboard contact area. This bootpad interface locks the attack angle at the desired angle. Preferably the pad ridges at compression which increases its friction against the boot.

The central mounting posts 3 are bolted to a circular baseplate 7 which in turn are bolted into the board 1 with bolts 8. The pads 4, 5 could be a decorative color mosaic. They must be abrasive resistant, preferably closed cell foam rubber fastened with glue. The pad depth is approximately ⅜ inch so as to grip the boot sole and cushion the ride. A ⅜-inch pad needs to compress ±⅛ inch.

Figure 2A:
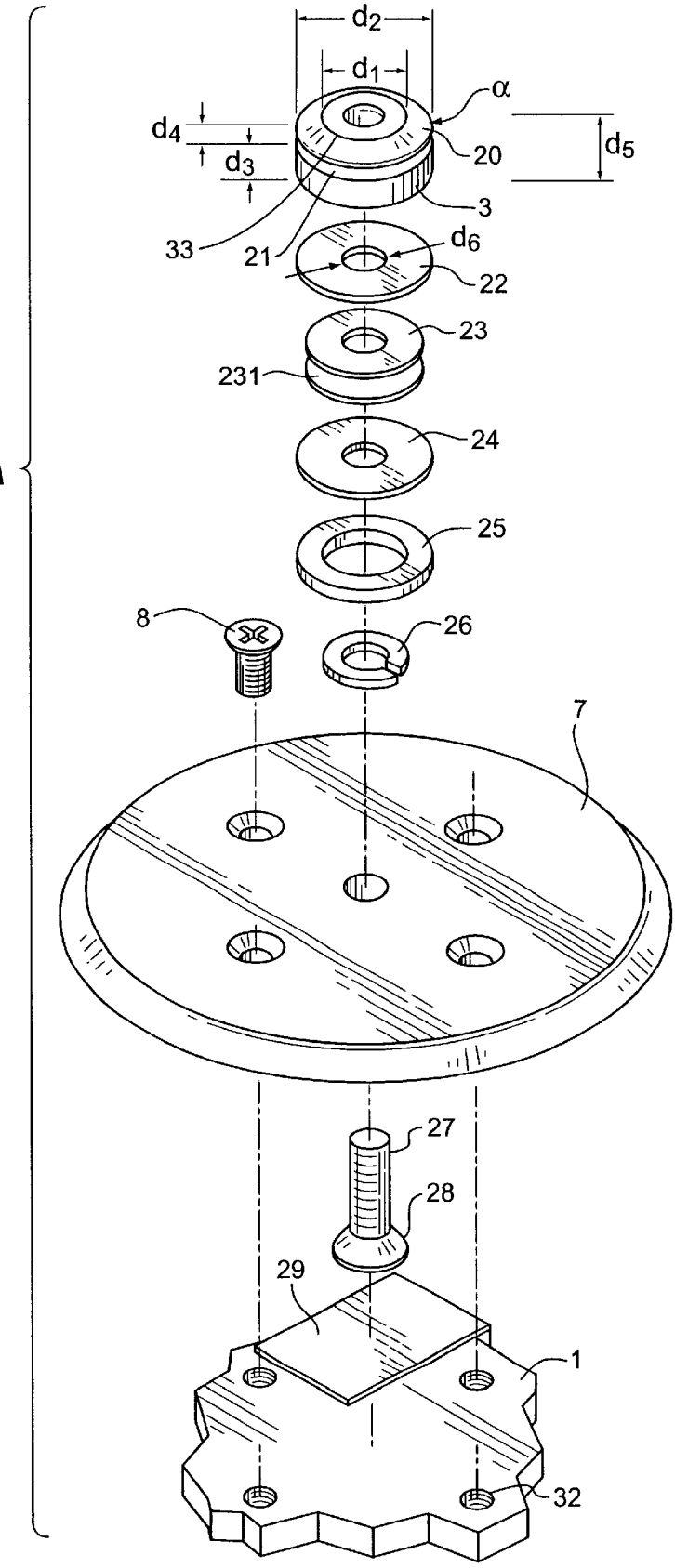
FIG. 2*a* is an exploded view of the binding base.
Figure 2B:
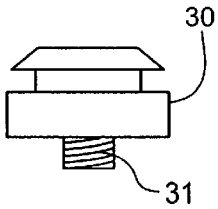
FIG. 2*b* is a side plan view of an alternate embodiment of a male thread central mounting post.

Referring next to FIG. 2*a* the central mounting post 3 has a locking groove 21 and an optionally slightly beveled upper edge 20 on the locking groove 21. Spacers 22, 23, 231, 24 are used to accommodate different boots having different receiving hole depths and to increase/decrease the rotational hold and the ease of entry. A rubber washer 25 reduces the torque on the locking bolt 27 and provides a slight cushioning effect for the boarder. A lock washer 26 under the mounting post acts to secure the locking bolt 27. The locking bolt 27 has a bugle head 28 to provide a slight horizontal play under force thereby keeping the cental mounting post in perpendicular alignment with the spring plate torqued. An optional buffer plate 29 protects the board 1 and keeps the bolt from spinning. Pre-existing board holes 32 receive the anchor bolts 8. FIG. 2*b* shows an alternate embodiment post 30 having a male bolt 31 built in. Nominal dimensions are $d_1$ −0.625", $d_2$=1.000", $d_3$=0.250", $d_4$=0.130", $d_5$=0.500", $d_6$=5/16" with 18 threads per inch, and $\alpha$=32.7°. All metal parts are preferably made of stainless steel except the spring plate which is made of coated spring steel. Edge 33 is the point where the central mounting post 3 first contacts the locking fork 502 shown in FIGS. 5*a,* 5*b.*

Figure 3:
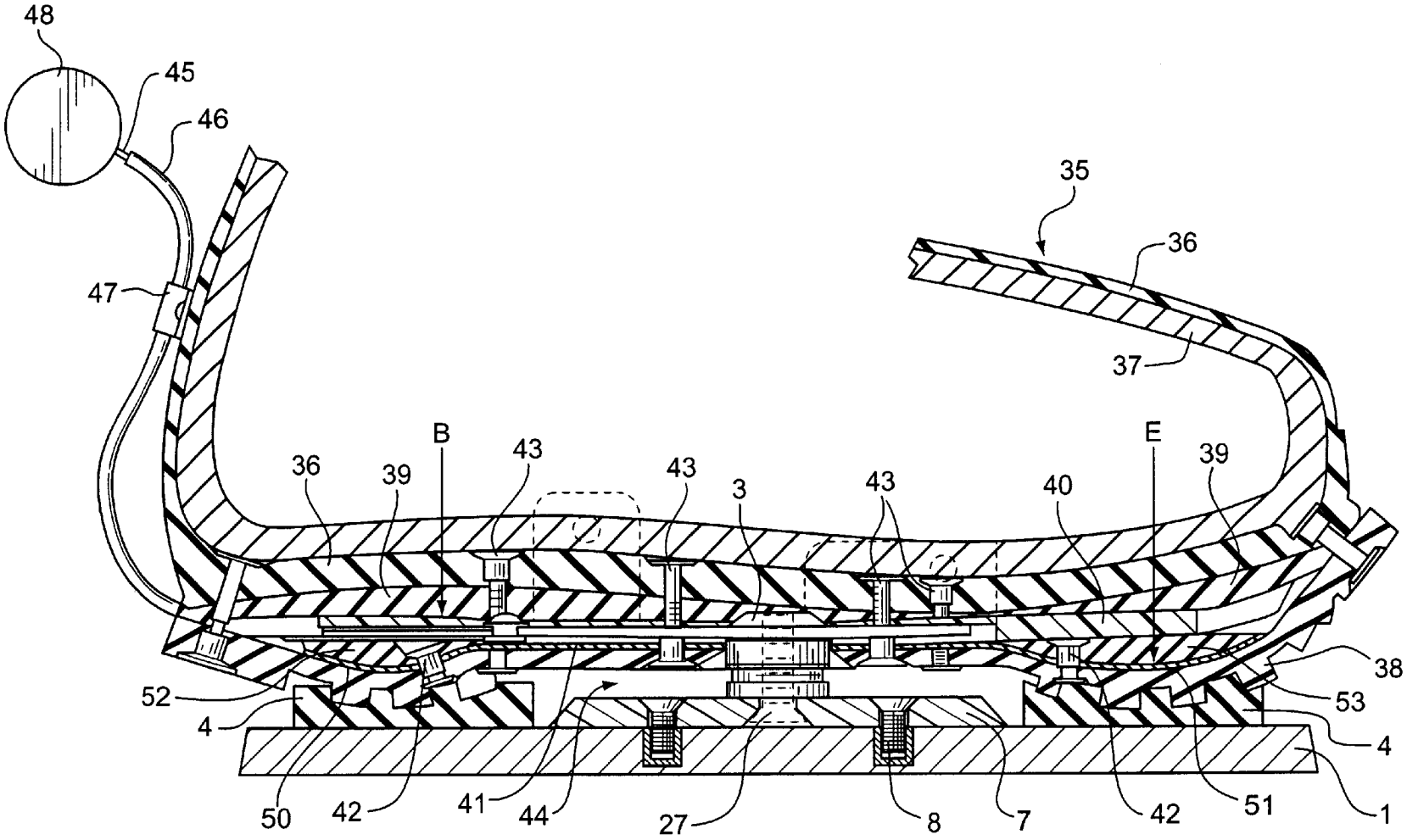
FIG. 3 is a longitudinal sectional view of a boot mounted on the binding base.
Figure 4A:
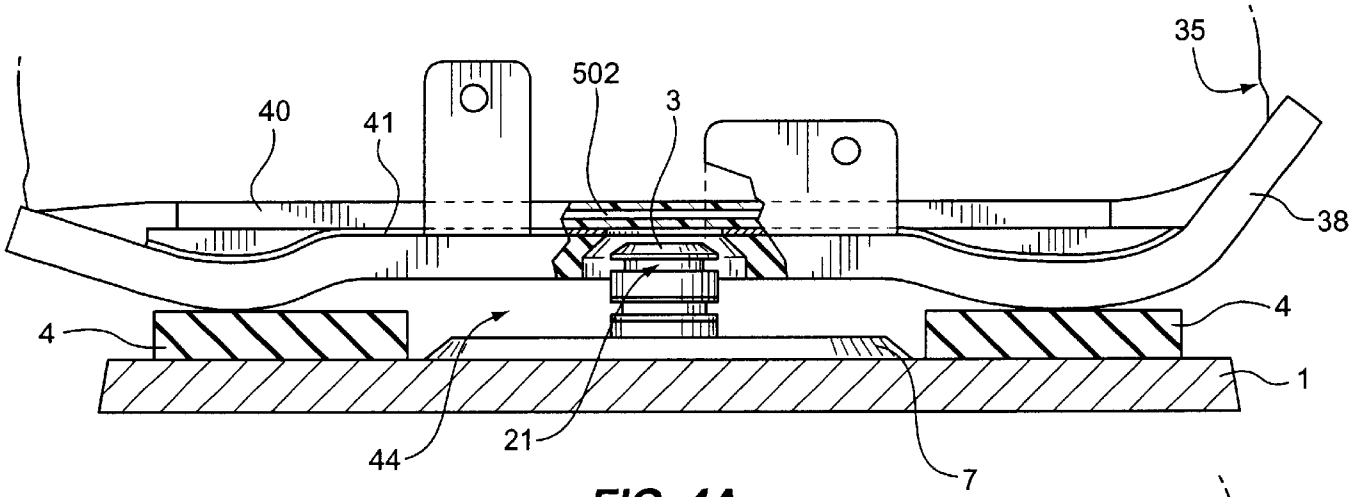
FIG. 4*a* is a longitudinal sectional view of a boot before the boarder applies his weight.
Figure 5A:
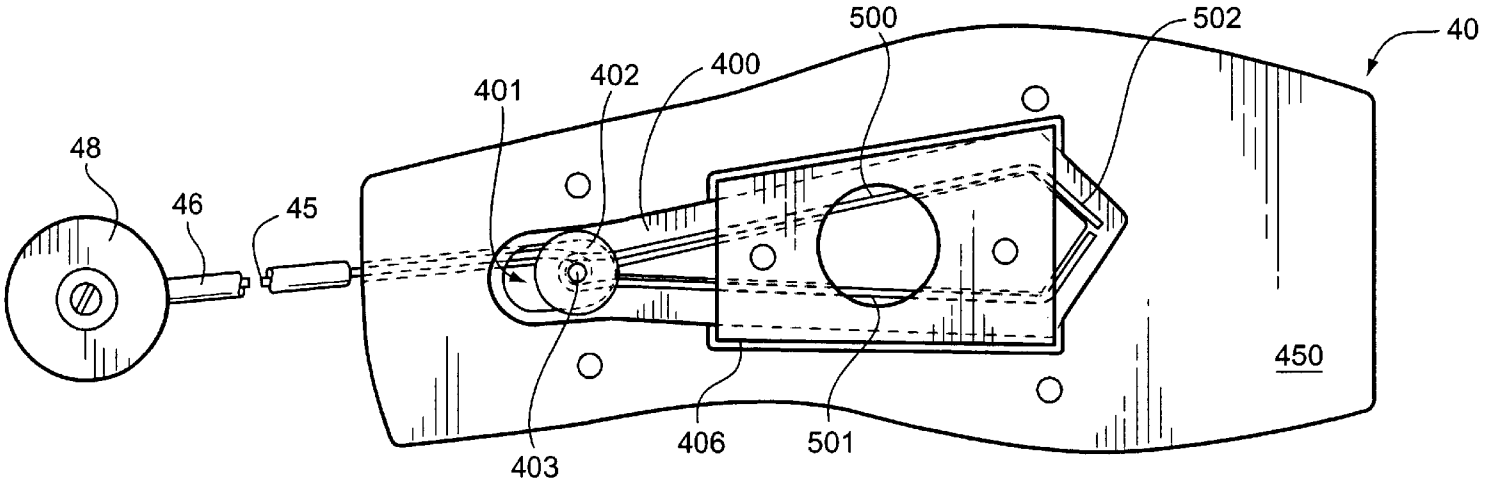
FIG. 5*a* is top plan view of the binding release assembly in the locked position.
Figure 5B:
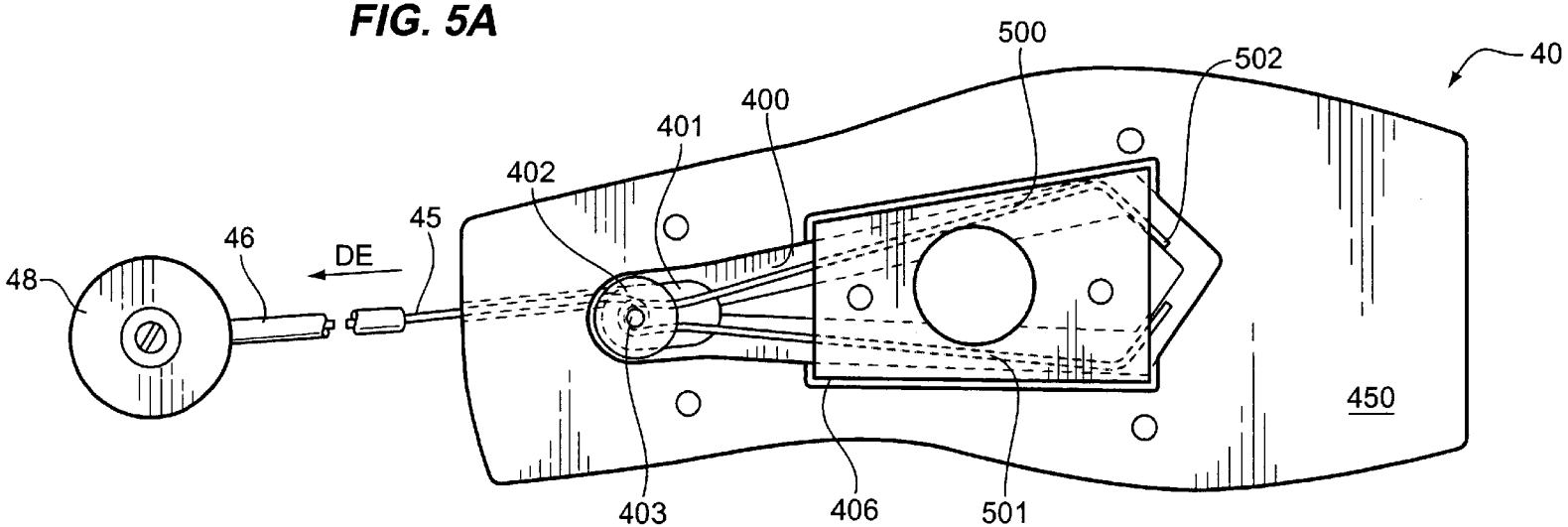
FIG. 5*b* is the same view as FIG. 5*a* wherein the mechanism is in the open/disengaged position.

Referring next to FIG. 3 the boot 35 has an outer shell 36 and a soft inner shell 37. An arch pad 39 may be included. A binding release assembly 40 engages/disengages the central mounting post 3 as shown in FIGS. 4*a,* 4*b.* An arch spring 41 has a concave heel portion 50 and a concave toe portion 51, thereby creating a variable hollow 44 between the sole 38 and the circular baseplate 7. The concave heel portion 50 has a rubber filler 52, and the concave toe portion 51 has a similar rubber filler 53 to provide a further cushioning for the boarder. Bolts 43 secure the outer shell 36 to the sole 38 through the binding release assembly. Alternatively, the bolts 43 may fasten along line B. Bolts 42 secure the arch spring 41 to the sole 38. Alternatively, the bolts 42 may fasten along line E. To release the central mounting post 3, the boarder pulls on handle 48 which pulls cable 45 and opens the locking fork 502 (as seen in FIGS. 5*a* and 5*b*). A sheath 46 is fastened to the boot 35 with clasp 47.

Figure 4B:
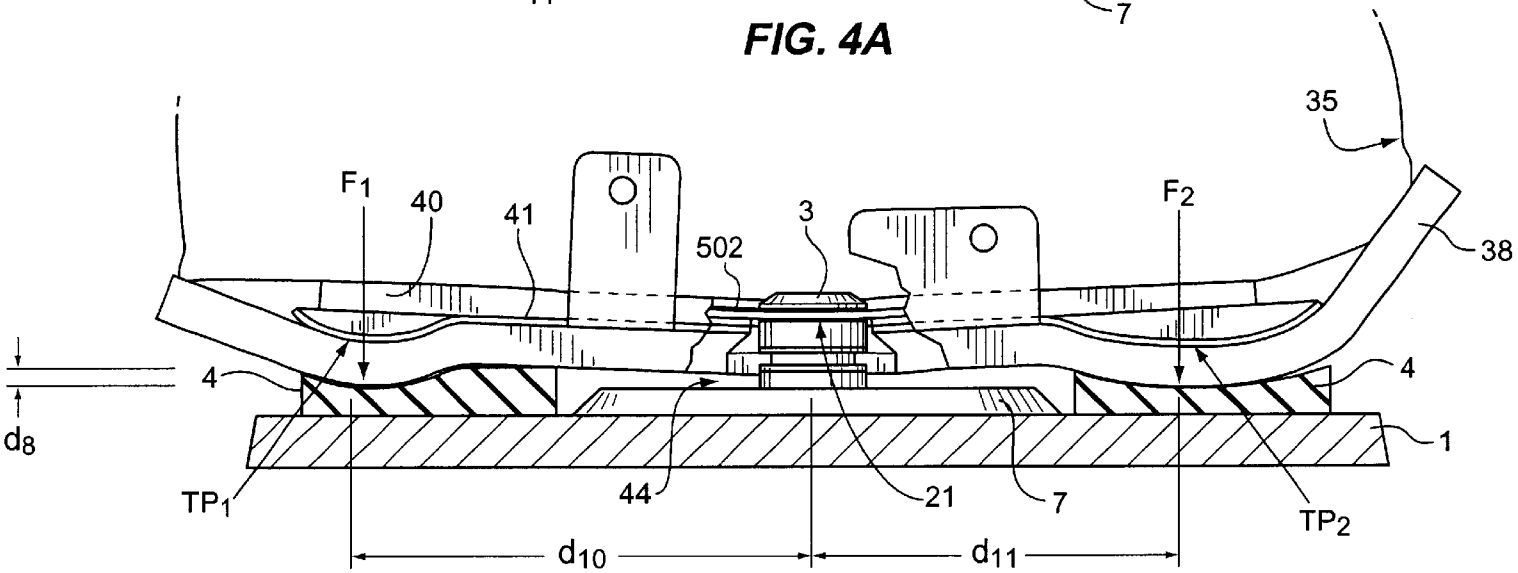
FIG. 4*b* is the same view as FIG. 4*a* wherein the boarder has applied his weight to the boot and engaged the binding base.

Referring next to FIGS. 4*a,* 4*b* the operation of engaging the boot 35 to the central mounting post 3 is shown. FIG. 4*a* shows the boarder placing his boot sole 38 at a desired attack angle along the pad 4. FIG. 4*b* shows the boarder applying his weight to boot 35, thereby bending arch spring 41 downward, reducing hollow 44, compressing pad a distance $d_8$ (about 3/16") at heel and toe areas of the boot 35, and engaging the locking fork 502 in the groove 21. It can be seen that the heel force $F_1$ and the toe force $F_2$ secure the boot 35 to the pad 4 at the desired attack angle. A large lever arm exists along $d_{10}$ for the heel and $d_{11}$ for the toe to ensure the boot 35 is secure. At the same time, a dynamic hinge for providing a cushioned ride is provided by pad 4. Control is improved by torque points $TP_1$ and $TP_2$ of FIG. 4*b* which increases the edge-to-edge weight transfer leverage. The torque points $TP_1$ and $TP_2$ are raised off the board and focused as opposed to lying flat along a boot sole.

Figure 8:
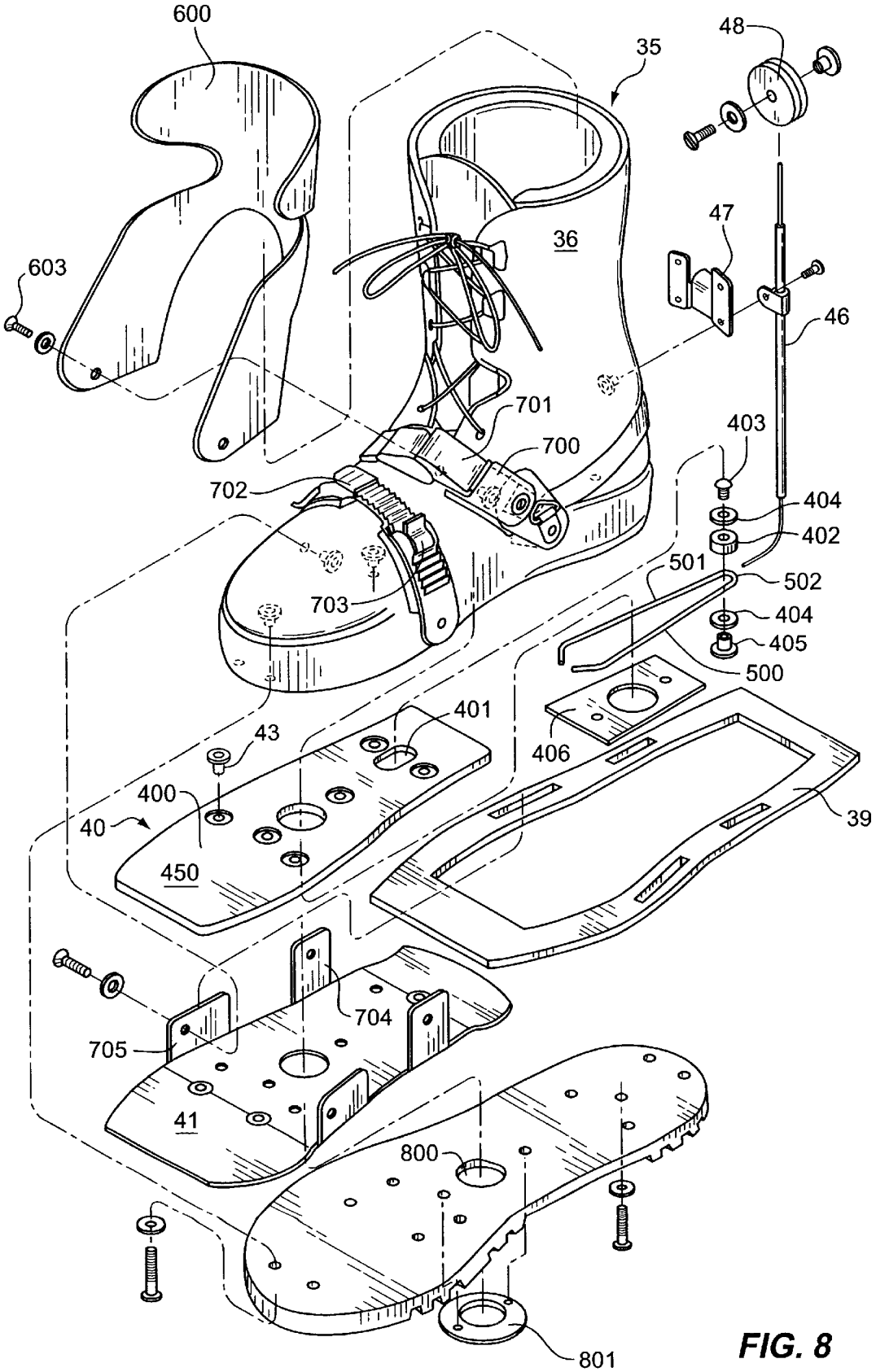
FIG. 8 is an exploded view of the boot shown in FIG. 7.
Figure 10:
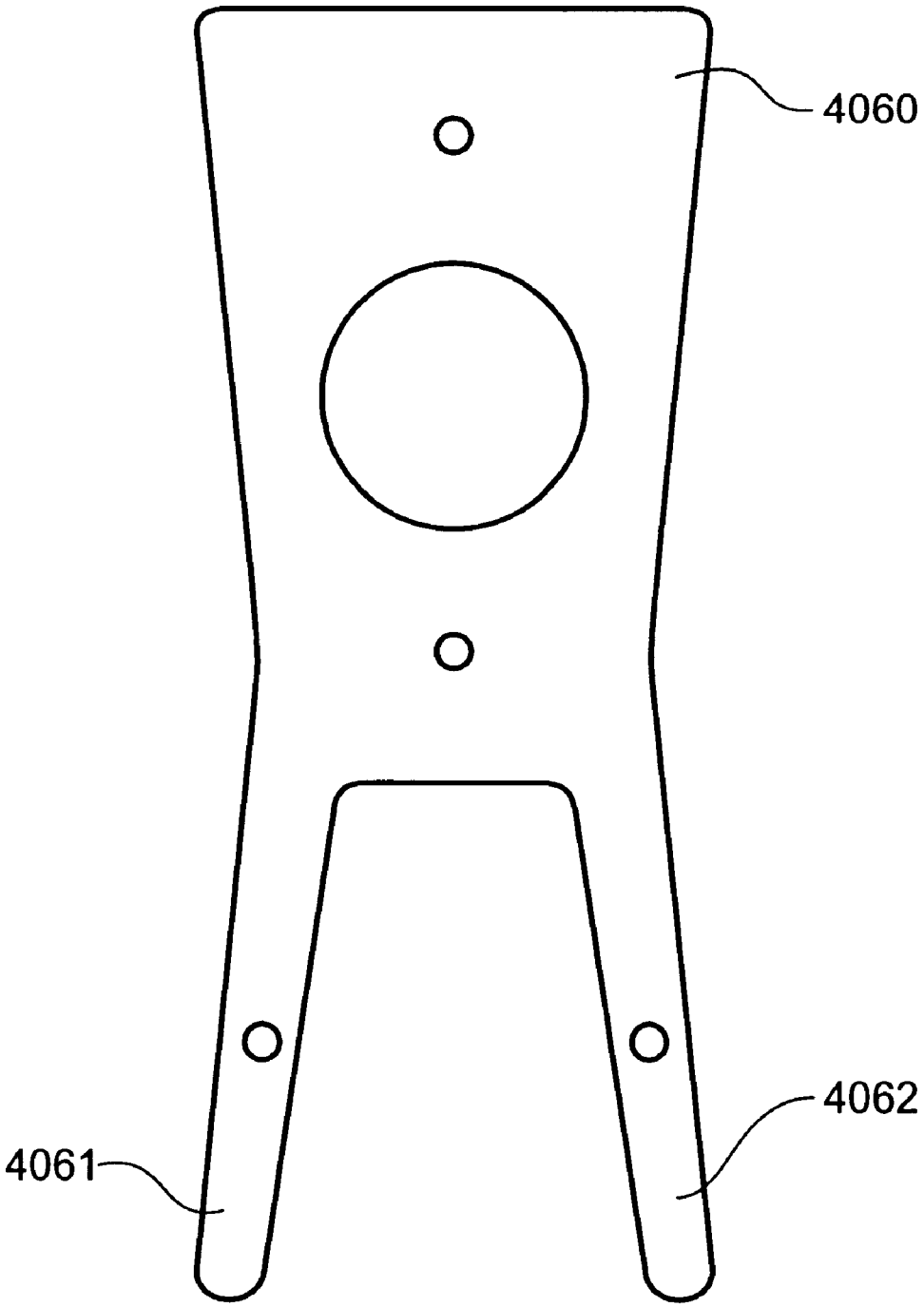
FIG. 10 is a top plan view of another fork plate.

Referring next to FIGS. 5*a,* 5*b* the binding release assembly 40 consists of an upper plate 450 having a recess 400 to house the locking fork 502. Left and right prongs 500, 501 of fork 502 expand when cable 45 pulls spreader washer 402 rearward as shown by arrow disengage, DE, in FIG. 5*b.* Bolt 403 secures the spreader washer 402 along with spacers 404 and nut 405 as seen in FIG. 8. Since locking fork 502 is a spring, the spreader washer 402 returns to the engaged position shown in FIG. 5*a.* A slot 401 permits movement of the spreader washer 402. A fork plate 406 is located below the prongs. It functions to keep the prongs straight with the rider's weight in the boot, thereby facilitating the release movement of pulling the prongs rearward. FIG. 10, shows a stiffer fork plate 4060 having stiffening arms 4061, 4062. The fork plates 460 or 4060 reduce the bend in the entire foot support assembly (41 and 450) which increases control during the ride.

Figure 6:
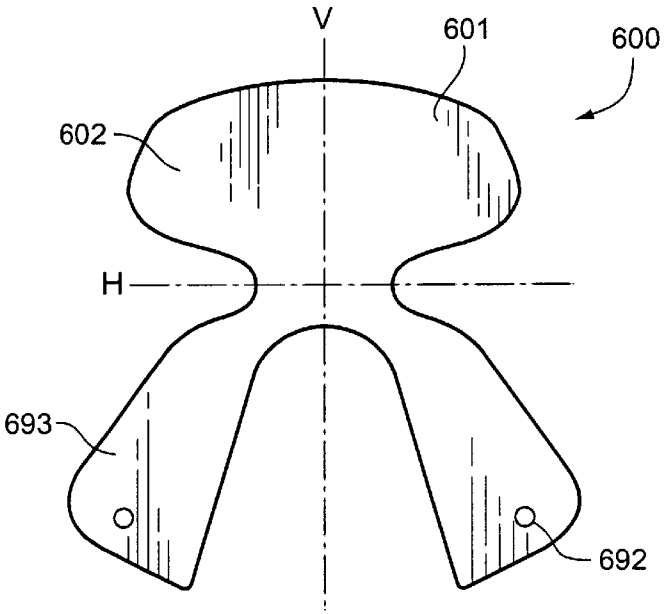
FIG. 6 is a front perspective view of a boot stiffener.

Referring next to FIG. 6 a boot stiffener 600 is plastic and folded into the boot heel as shown in FIG. 8. Bending along the horizontal axis H helps control the forward pitch. Bending along the vertical axis V helps control the sidewards roll. Optional padding 601 adjusts the backward lean support and provides a greater natural forward lean. Holes 692 allow a nut/bolt 603 (see FIG. 8) to secure the stiffener 600 to the shell 36 of the boot 35. Arms 602 and legs 693 are shown in their preferred shape.

Figure 7:
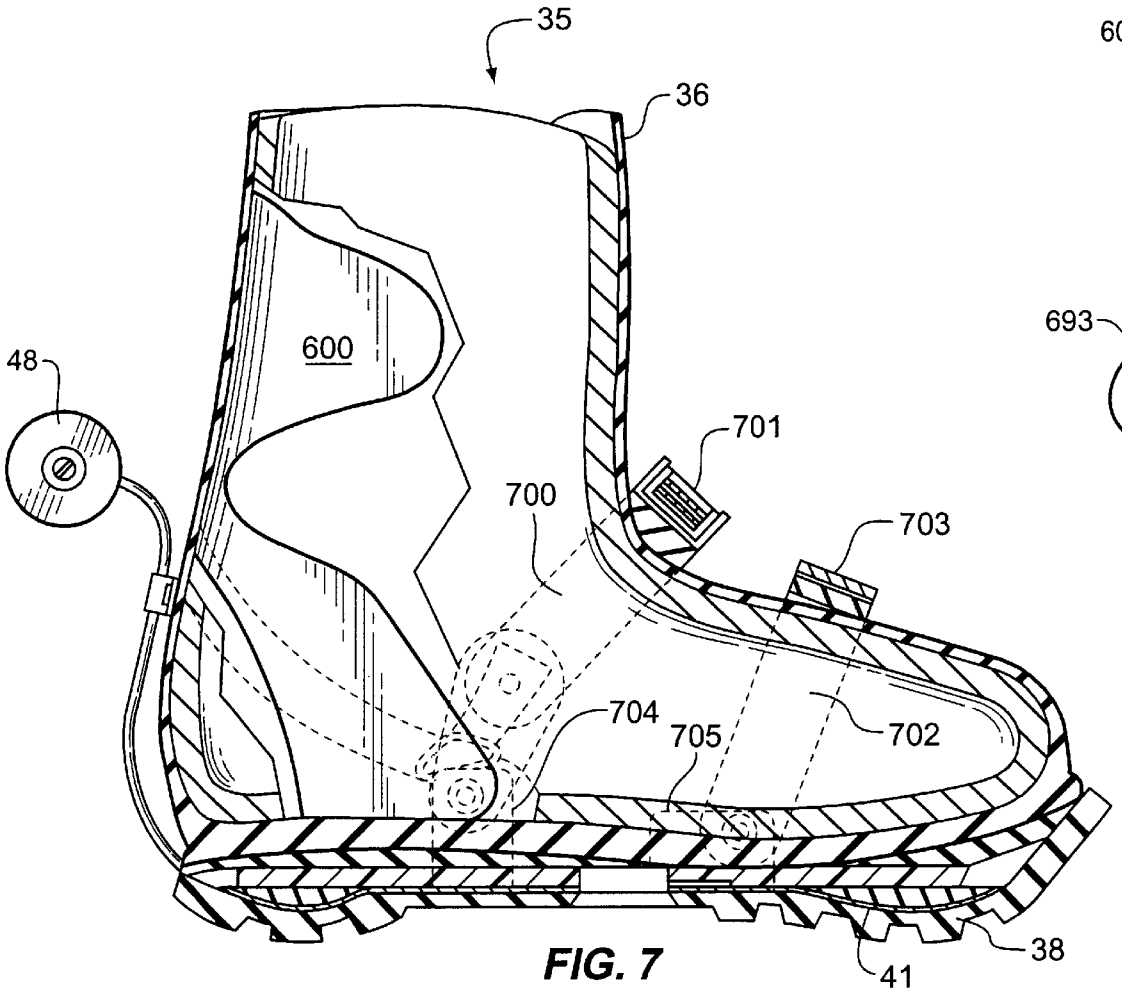
FIG. 7 is a longitudinal sectional view of a boot with binding.

Referring next to FIG. 7 two quick-release straps 700,702 hold the boarder's foot securely in the soft boot 35. Anchors 704, 705 are part of the arch spring 41. Quick-release clasps 701, 703 allow the boarder to secure his foot in the boot with the clasps 701, 703. Now the boarder can mount the binding in a single movement step-in motion. Referring next to FIG. 8 the sole is shown to have receiving hole 800 and an optional post feed washer 801 which has a concave lower surface to feed the central mounting post. The arch spring 41 is mounted atop the sole, and the arch pad or gasket 39 may be contoured as desired for comfort and used to fill in around the plate. It centers the upper plate 450 of the release assembly 40. A standard boot could be altered to house the binding components or a custom boot is preferred. Also the boot could be modified with a cutout in the foot bed of the boot to house the binding release assembly (41, 450, 502), thus eliminating the gasket 39.

Figure 9:
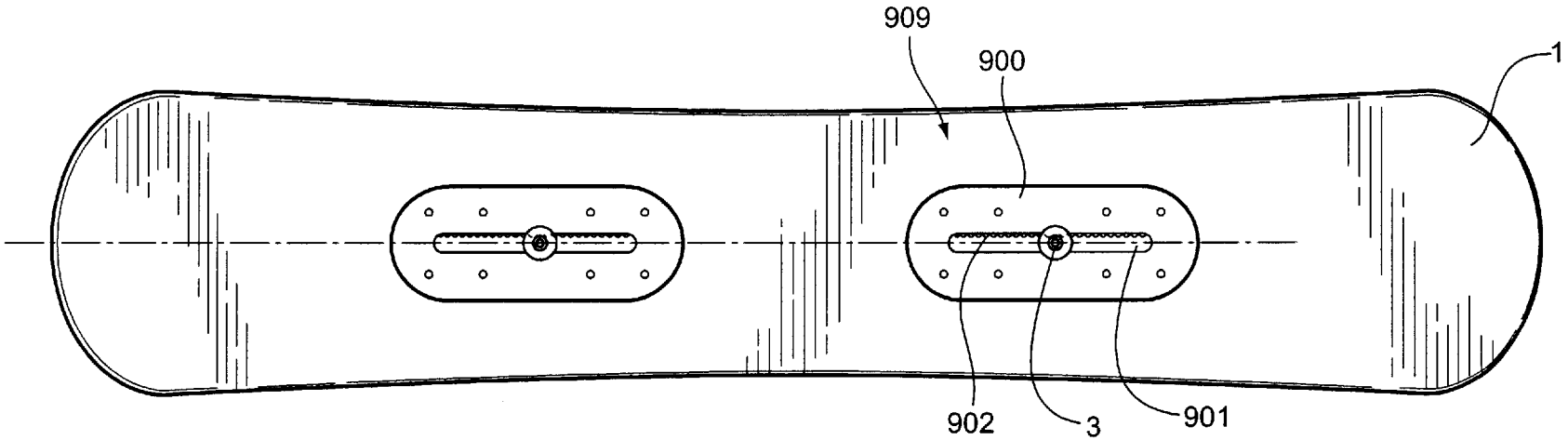
FIG. 9 is a top plan view of an alternate embodiment of the binding base having tracks for the central mounting post to provide a variable width stance.

Referring next to FIG. 9 an alternate embodiment 909 of the baseplate is shown. The baseplate 7 of FIG. 2 has been replaced with an elongate (preferably plastic) baseplate 900 having a slot 901 to provide a stance width adjustment. The notches 902 help lock the moving central mounting post 3 (shown in FIG. 2a) to a desired position on or off the hill by unscrewing the central mounting post 3.

Referring next to FIG. 10 a fork plate 4060 is shown to have stiffening arms 4061, 4062.

Figure 11:
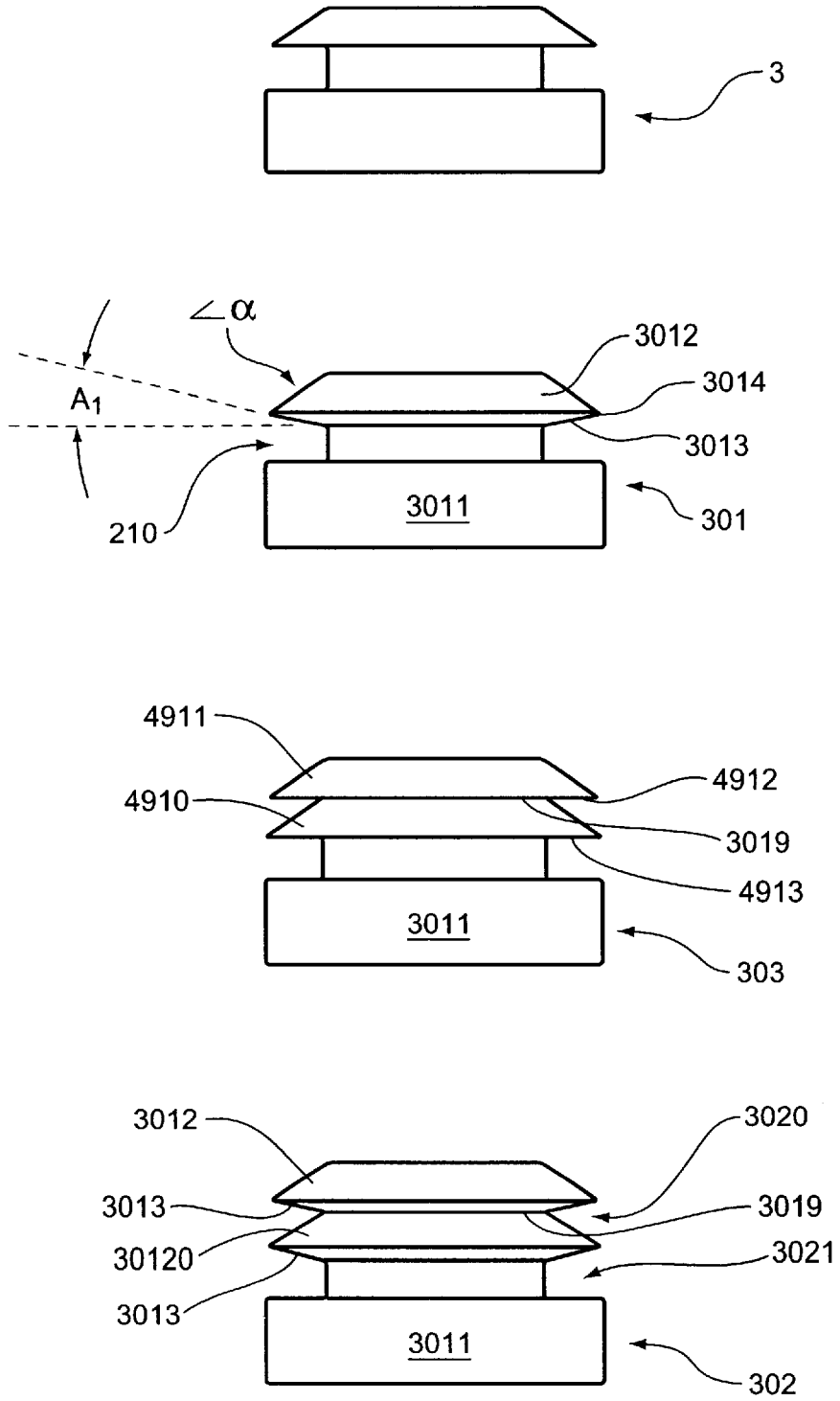
FIG. 11 is a side plan view of three additional mounting post embodiments and a primary mounting post.

Referring next to FIG. 11, which shows a normal central mounting post 3 and three alternate embodiments of a central mounting post numbered 301, 302, 303. Post 301 is a beveled version of post 3 shown in FIG. 2*a*. The locking groove 210 is formed between the base 3011 and the retaining lip 3012. Locking surface 3013 of retaining lip 3012, 30120 has an angle $A_1$ relative to the horizontal shown in dashes. This angle $A_1$ can be selected to allow the rider to automatically release at a predetermined force during his ride. The greater angle $A_1$ is, the less force is required to automatically release from the binding. Thus, beginners may choose a large angle $A_1$ since they fall a lot. The retaining lip 3012 has a distal end 3014 which is blunted. Angle $\alpha$ determines the necessary downward force from the rider for entry. The preferred angle is 32.7 degrees.

Post 302 has two retaining lips 3012 and 30120 connected at point 3019. Thus, two locking grooves 3020, 3021 are created. This is useful for a rider who has released and cannot put a strong force down on the post 302 such as when he's on a steep slope. This post 302 is double beveled and allows him to easily snap into locking groove 3020. Next he can ride to a safer location. Next he can fully engage the binding by pressing down and engaging the locking groove 3021.

The post 303 is a double locking groove version like post 302. However, retaining lips 4911, 4910 have straight horizontal lips 4912, 4913.

Figure 12:
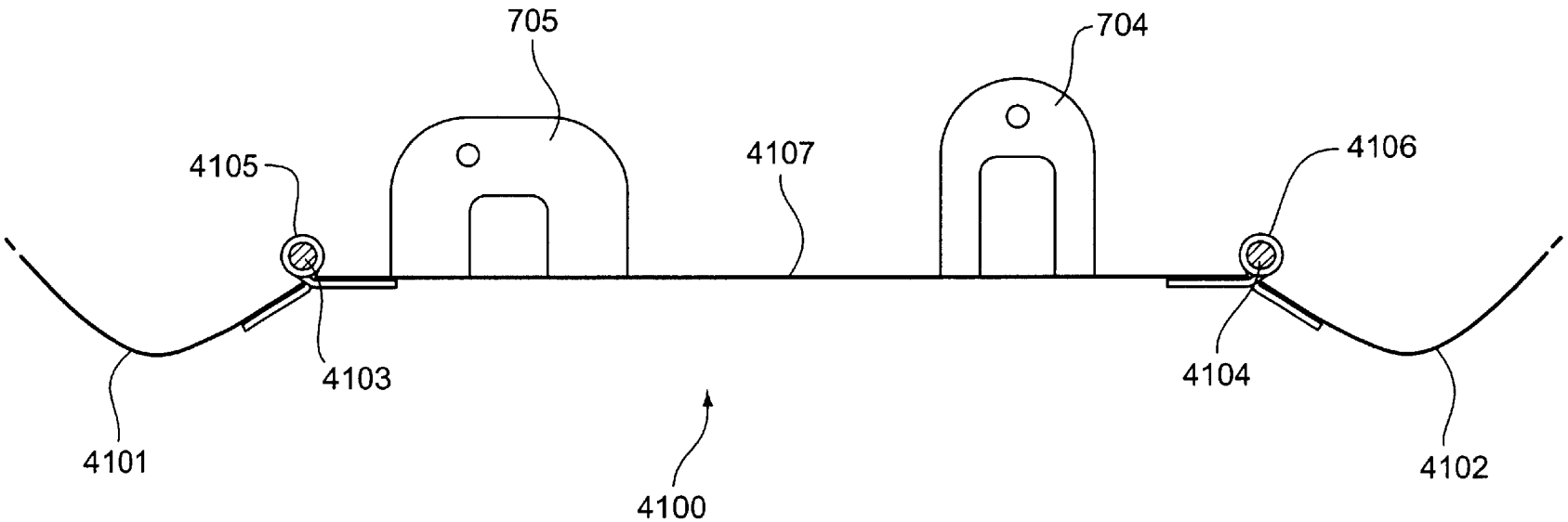
FIG. 12 is a side plan view of an alternate embodiment arch spring.
Figure 13:
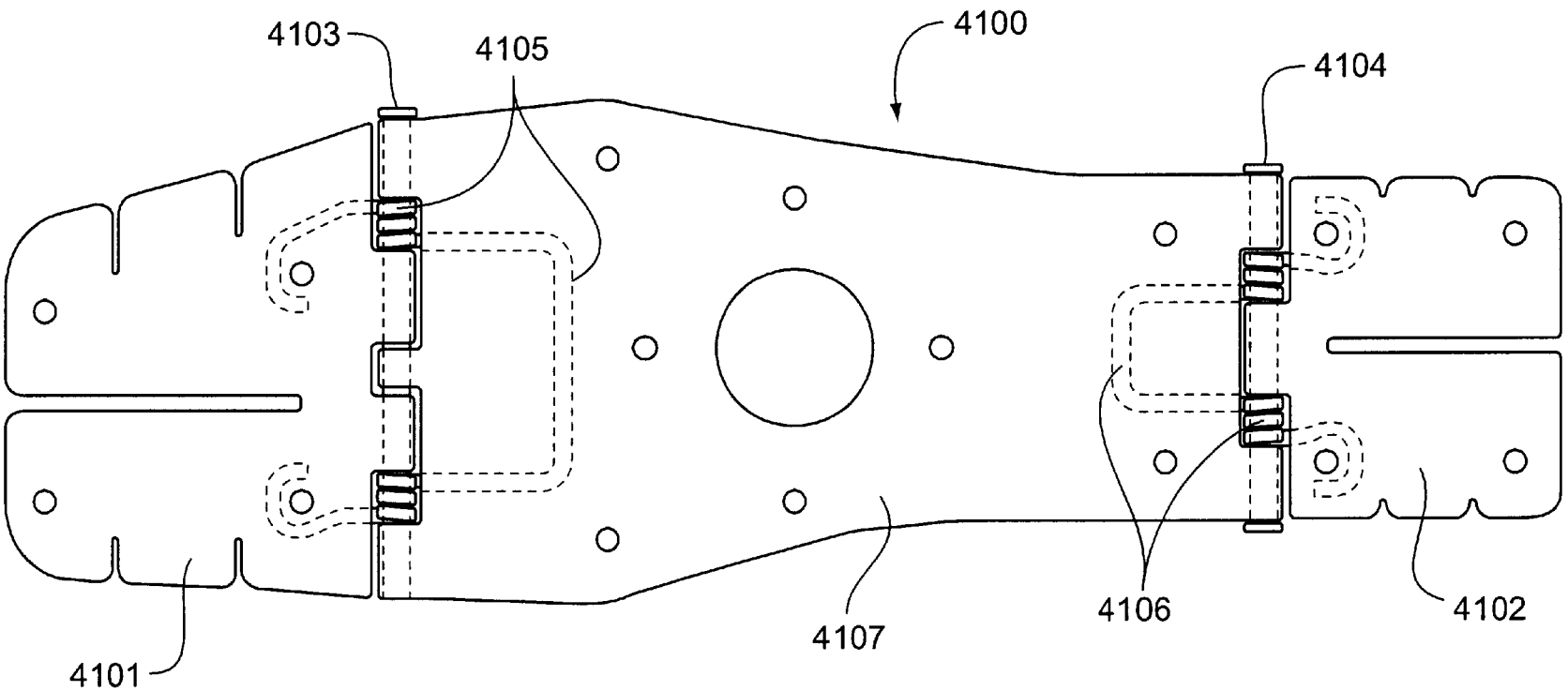
FIG. 13 is a top plan view of the arch spring of FIG. 12.

Referring next to FIGS. 12,13 an alternate embodiment arch spring 4100 is shown, wherein the toe member 4101 and the heel member 4102 are separate pieces hinged at axle pins 4103, 4104 respectively. Springs 4105, 4106 can be selected by the rider to customize his ride. The central plate 4107 will remain relatively flat during the ride and during the release. This facilitates the release by bending the locking fork 502 less (FIG. 8). Also walking becomes easier with the flexibility of independent toe and heel members.

Although the present invention has been described with reference to preferred embodiments, numerous modifications and variations can be made and still the result will come within the scope of the invention. No limitation with respect to the specific embodiments disclosed herein is intended or should be inferred.

I claim:

1. A binding and boot system for attaching a boarder's foot to a snowboard, said system comprising:

a boot having an arch spring in a sole;

said boot having a central hole in the sole for receiving the central mounting post;

said arch spring having a hole to receive the central mounting post;

a quick release assembly to engage the central mounting post;

said central mounting post having a fixed location on the snowboard; and a friction pad surrounding said central mounting post to grip the sole.

2. The system of claim 1, wherein the quick release assembly further comprises a locking fork which fastens in a groove on the central mounting post.

3. The system of claim 2, wherein the locking fork further comprises a pair of arms mounted at an acute angle relative to each other, said locking fork further comprising a sliding engagement to the boot to a forward locked mode and a rearward release mode, wherein the groove of the central mounting post is disengaged from the pair of arms in the rearward release mode.

4. The system of claim 1, wherein the arch spring further comprises a downward depending toe and heel segment each forming a torque point, wherein said toe and heel segments transmit a boarder's weight via the sole to the friction pad in the 360° range of positions of the boot, thereby providing a torsion ride.

5. The system of claim 4, wherein the friction pad has a shape surrounding the central mounting post and having a segment under the torque points.

6. The system of claim 1, wherein the central mounting post further comprises a bolted engagement to a mounting plate, said mounting plate having a locked engagement to the snowboard.

7. The system of claim 3, wherein the boot further comprises a sole having a flexible plate with a recess to house the locking fork.

8. The system of claim 1, wherein the boot further comprises a boot stiffener having a left and a right leg and a back and which is folded into a boot heel to help control a forward pitch and a sideways roll of the boarder.

9. The system of claim 1, wherein the arch spring further comprises a left and a right anchor and a strap attached to each and a quick release clasp member attached to each strap.

10. The system of claim 1, wherein the sole further comprises a post feed washer around said central hole.

11. The system of claim 7, wherein the sole further comprises an arch pad.

12. The system of claim 3, wherein the locking fork further comprises a spreader washer; and a pair of forward arms to return the locking fork to the forward locked mode when a cable at a rear of the locking fork is not pulled.

13. The system of claim 12, wherein the locking fork further comprises a fork plate located below the locking fork, thereby maintaining the locking fork in a relatively horizontal alignment under a boarder's weight.

14. The system of claim 6, wherein the mounting plate further comprises a slot which houses a movable central mounting post, thereby providing an adjustable width stance.

15. The system of claim 1, wherein the central mounting post further comprises a retaining lip having an angled lower release segment to provide an automatic release of the binding at a preset upward force.

16. The system of claim 1, wherein the central mounting post further comprises two locking grooves, wherein an upper locking groove is engaged with less force than a lower locking groove.

17. The system of claim 1, wherein the arch spring further comprises a hinged toe member and a hinged heel member.

18. The system of claim 17, wherein each of said hinges further comprises a spring that is selectable by a user, thereby providing a customized shock absorbing suspension.

19. A one motion step-in binding system for use with a snowboard, comprising:

a central mounting post configured to attach to a snowboard riding surface of the snowboard, the central mounting post having a locking groove;

a boot having a sole comprising a receiving hole for the central mounting post and a longitudinal spring, the sole having a release assembly to receive the locking groove of the central mounting post, the longitudinal spring having a curve to transmit a portion of a rider's weight to a toe and a heel portion of the boot; and a boot to board lock assembly configured to attach to the snowboard riding surface of the snowboard, the boot to board lock assembly provides a releasable connection of the boot to the snowboard at a desired angle.

20. The system of claim 19, wherein the boot to board lock assembly further comprises a friction device on the snowboard.

21. The system of claim 20, wherein the friction devices is a pad surrounding the central mounting post.

22. A central post type binding system for use with a snowboard, comprising:

a central mounting post configured to attach to a snowboard;

a boot having a sole comprising a receiving hole for the central mounting post and having a latch to connect to the central mounting post, the latch comprising a locking fork; and said central mounting post further comprises a retaining lip having an angled lower release segment to allow the latch to release at a preset upward force.

* * * * *